United States Patent [19]

Zorzi

[11] 4,079,105

[45] Mar. 14, 1978

[54] PRODUCTION OF REFRACTORY LININGS IN METALLURGICAL VESSELS

[75] Inventor: Joseph Sante David Zorzi, Seraing, Belgium

[73] Assignee: Societe Anonyme Cockerill Ougree Providence et Esperance-Longdoz, Belgium

[21] Appl. No.: 687,208

[22] Filed: May 17, 1976

[30] Foreign Application Priority Data

May 21, 1975 Belgium ..... 829339

[51] Int. Cl.[2] ..... F27D 1/16

[52] U.S. Cl. ..... 264/30; 266/281

[58] Field of Search ..... 264/30, 44; 266/281

[56] References Cited

U.S. PATENT DOCUMENTS

| | | | |
|---|---|---|---|
| 3,467,738 | 9/1969 | Pyzel | 264/30 |

FOREIGN PATENT DOCUMENTS

| | | | |
|---|---|---|---|
| 1,303,302 | 8/1971 | Germany | 266/281 |
| 621,695 | 10/1935 | Germany | 266/281 |
| 47-39,802 | 7/1972 | Japan | 266/281 |

*Primary Examiner*—Thomas P. Pavelko

*Attorney, Agent, or Firm*—Holman & Stern

[57] ABSTRACT

A refractory lining in a metallurgical vessel is produced by tamping and/or slinging crude sand. Upon drying of the sand, evaporation of water contained in the sand is ensured by means of drains formed by hollow elongate bodies placed in position according to a suitable arrangement before depositing sand.

10 Claims, 2 Drawing Figures

PRODUCTION OF REFRACTORY LININGS IN METALLURGICAL VESSELS

BACKGROUND OF THE INVENTION

The present invention relates to a method of producing a refractory lining in a metallurgical vessel designed to contain molten metal, such as a ladle used for casting steel.

Metallurgical vessels designed to contain molten metal generally comprise a metal shell whose inner surface is covered by a lining of refractory material to avoid any direct contact between the molten metal and the shell. So far as the peripheral internal surface is concerned, the refractory metal covering it generally comprises a layer of tamped sand applied from the bottom upwards. When that sand becomes worn and its thickness becomes insufficient to ensure effective protection, one proceeds to remake the lining by covering the bottom with refractory sand slung onto it by means of a sand-slinger.

The refractory lining forming the bottom of such vessels generally consists of brickwork. This kind of construction is not entirely satisfactory, since discontinuities between bricks form weak areas through which molten metal infiltrates, thereby prematurely putting the refractory lining out of use. This disadvantage impairs the useful life of the refractory. In order to remedy this disadvantage, the applicant has already suggested the following method. One locates on the bottom of a metal shell a first removable annular mould identical in shape to the peripheral contour of the bottom so as to define, between the lateral wall of the vessel and the mould, a continuous zone equal in height to the thickness of the bottom to be built and having a sufficiently reduced width to obtain a desired homogeneous degree of compaction throughout the surface of this zone. One fills that zone with crude sand of suitable composition, the zone is tamped, and the first mould is removed. A second mould similar to the first one, but smaller in size, is then placed in position so as to define a second tamping zone, and so on, until the central zone delimited by the last mould has a width approximately equal to that of the other tamped zones.

By means of ordinary sand and without using a binder, the applicant has been able to produce bottoms whose life is longer than that of the walls, which at present is 33 castings on average. The suggested solution has been found to be very satisfactory.

The present way of producing a lining still has, however, the following drawbacks. Sintering of the refractory takes place only in the absence of humidity. On the other hand, drying of the refractory starts from the surface thereof. This results in the surface part which has been sintered first preventing to a considerable extent evaporation of water contained in the underlying sand from taking place and stopping sintering from continuing in the sand. It would thus be advantageous to systematically and uniformly dry the refractory. Such a drying operation could remedy to a great extent difficulties in the toughness of the refractory, particularly of the bottom, especially when dealing with large dimensions. Moreover, an improvement in sintering would surely result in an increase of the life of the refractory.

It should be noted, however, that a certain improvement has already been achieved by the applicant by means of the method of producing bottom linings by using the moulds referred to above. It has been suggested in that method to spread a layer of loose sand on the layer to be dried, the sand serving to prevent direct contact between a drying flame and the moist layer in the vessel and to allow more progressive drying. This solution adopted for vessels of average capacity (60 t ladles), is not satisfactory for vessels of greater size.

It will be also noted that good toughness of the refractory materials does not depend only on the quality of the drying operation to which the refractory is subjected. More particularly, the bottoms have an increasingly defective toughness in proportion as their diameter increases (weight increase), independently of the care taken in drying them. It then appears that sintering alone is insufficient to guarantee good toughness for a considerable mass of refractory. Vessels used in metallurgy have increasingly great dimensions and this tendency is growing, which makes the problem of the toughness of the refractory lining more acute.

SUMMARY OF THE INVENTION

An object of the present invention is to provide a method allowing this drawback to be remedied.

The present invention provides a method in which a refractory lining in a metallurgical vessel is produced by tamping and/or slinging crude sand, and in which, during drying, evaporation of water contained in the sand is ensured by means of drains formed by longitudinal hollow bodies placed in position according to a suitable distribution before deposition of the crude sand.

Each drain preferably extends throughout the thickness of the lining, one end thereof reaching the inner surface of the lining. The drains may each have a base designed to hold them in position and to form a fixing member for attachment in the sand as well as a reinforcing frame for the lining.

In order to uniformly evaporate water contained in the sand both at the base and throughout the whole amount of sand, use is made of drains whose walls define a great evaporation surface. In the case where the drains consist of a poorly porous material, bores are formed in the wall of the drains over their entire length and around their entire periphery.

Synchronism is achieved between the wear rate of the lining and that of the drains when the drains consist of a material, copper for example, whose melting point is considerably lower than that of the metal to be contained in the metallurgical vessel. In this way, in proportion as the top of the drain becomes uncovered owing to wear of the lining, the uncovered part melts under the action of the high temperatures of the metal in contact with the uncovered part.

It is possible to stuff the hollow part of each drain with a wick, e.g. of a chemically inert material, such as asbestos, the wick projecting from the ends of each drain; this method prevents molten metal in the vessel from eroding the thin layer of sand normally present between the base of the drain and the metal bottom of the vessel, and thus from forming holes in the bottom. Moreover, the chemically inert material used to stuff the hollow part of the drain is preferably designed to absorb and to discharge towards the surface humidity from the bottom, thereby permitting a readier and more rapid drying.

It has been found advantageous to distribute the drains throughout the surface to be dried and to maintain a spacing 25 to 35 cm between the drains. The drains may be disposed staggered so as to form a pattern of equilateral triangles.

In the case where the bottom is produced by using removable annular moulds, the various drains (located along a series of circumferences) advantageously rest against the moulds to facilitate holding in position thereof.

The various drains may be connected together so as to form a lattice assembly to facilitate holding the drains in position and to assist their role of reinforcing elements.

A device for carrying out the above-described method comprises a hollow longitudinal body, such as a sufficiently stiff tube capable of resisting deterioration upon tamping and having a very porous wall, the body having a base for holding it in position, the body being stuffed with a material, asbestos for example, projecting from both its ends, and the length of the body being substantially equal to the thickness of the lining to be drained.

The material used for stuffing the hollow part of the drains is advantageously a chemically inert material, particularly with respect to the elements with which it is in contact. The wall of the longitudinal body forming the drain is preferably formed with bores over its entire length and throughout its periphery, which ensures considerable porosity.

The base of the hollow body is preferably formed by a portion of the hollow body bent at 90° with respect to its longitudinal axis.

BRIEF DESCRIPTION OF THE DRAWINGS

The invention will be described further, by way of example only, with reference to the accompanying drawings, in which.

DETAILED DESCRIPTION OF PREFERRED EMBODIMENTS

Figure 1:
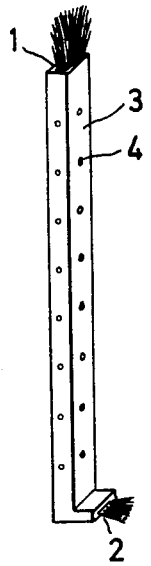
FIG. 1 is a perspective view of a device designed to be used as a drain for the production of a refractory bottom in a casting ladle.

The drain shown in FIG. 1 has been used for producing a bottom of a 60 ton steel ladle. This drain comprises a box-section copper tube 25 cm long stuffed with a wick of asbestos projecting from the ends 1 and 2. The base of the drain designed to hold it in position, comprises the tube end 2, which has been perpendicularly bent with respect to the length of the tube. The four faces 3 of the drain have been formed with bores 4 over the entire length, the bores having a diameter of 0.5 cm.

Figure 2:
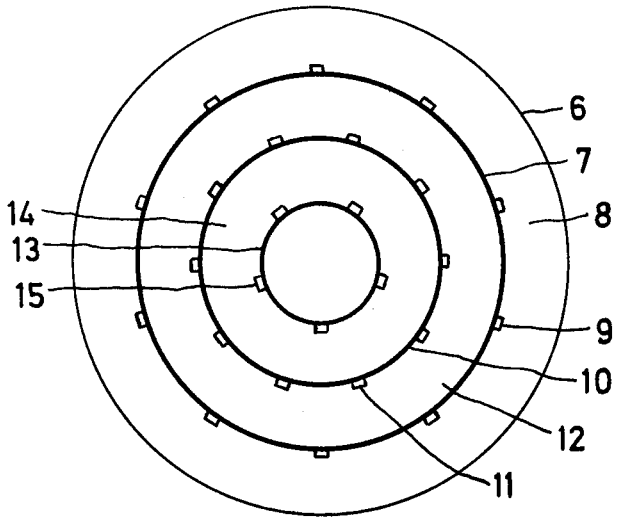
FIG. 2 is a diagrammatic plan view of a particular arrangement of the drains in a tamped bottom of the casting ladle.

In order to produce the bottom shown in FIG. 2, removable circular moulds have been used, such moulds delimiting annular zones which are successively filled with crude wet sand and tamped. The circle 6 represents the peripheral contour of the bottom, whereas the circle 7 represents the first mould used for delimiting a first annular zone 8. Before filling this first zone 8 with sand, drains 9 (as described above) are placed against the mould 7 at a distance of about 30 cm from one another. After tamping of the crude sand filling the zone 8, the mould 7 is removed and the drains 9 remain in position owing to their bases 2 (FIG. 1) which act as an anchoring element in the tamped material. A second circular mould 10 is then located in position and drains 11 are arranged against the mould 10 at a distance of about 30 cm from one another, the width of the annular zone 12 delimited by the mould 10 being equal to the height of an equilateral triangle whose sides are about 30 cm long. In this way, the drains forming the two first circular rows are arranged staggered and define a succession of equilateral triangles whose sides are about 30 cm long. After filling the zone 12 with crude sand and after tamping, the mould 10 is removed and the third circular mould 13 is located in position, thereby delimiting a new annular zone 14. In this zone 14, drains 15 are first located against the mould 13 at about 30 cm from one another, the zone 14 is filled with crude sand and the sand is tamped as before, and so on until the central zone is formed, the latter in the given example comprising only 5 drains also spaced at about 30 cm.

The drain arrangement shown in FIG. 2 allows a better evacuation of water contained in the drained zone. It will be appreciated that water located in the region close to a drain is absorbed through the bores in the copper tube by the asbestos vertically disposed inside the tube and projecting from its two ends. The bottom is fired in a conventional way, e.g. by a flame or by filling the ladle with molten steel, and evaporation of the water in the sand takes place during this operation.

As mentioned above, the bent base of the drains forms a fixing element in the tamped material, and also forms a reinforcing frame for the bottom, which is quite desirable particularly in the case of 200 ton ladles, for which the weight of the tamped sand is a danger when the ladle is tilted.

I claim:

1. A method of producing a refractory lining in a metallurgical vessel, comprising the steps of: providing a plurality of drains constituted by elongate hollow bodies, each of the drains having a base designed to maintain it in a substantially perpendicular position; arranging the plurality of drains on the interior of the vessel with the longitudinal axis of the drains being substantially perpendicular to the surface on which the drains rest; filling the interior of the vessel with crude wet sand; compacting the crude sand around the drains to form a refractory lining; and drying the sand with evaporation of water in the sand through the drains.

2. The method as claimed in claim 1, in which each drain extends through the thickness of the lining, one end of each drain reaching the inner surface of the lining.

3. The method as claimed in claim 1, in which use is made of drains whose walls have a great evaporation area.

4. The method as claimed in claim 1, further comprising, prior to arranging the drains, forming bores in the walls of the drains over their entire length and around the entire periphery.

5. The method as claimed in claim 1, in which the drains are made of a meterial whose melting point is considerably lower than that of the metal to be contained in the metallurgical vessel.

6. The method as claimed in claim 1, further comprising, prior to arranging the drains, stuffing the hollow part of each drain with a wick which projects from the two ends of each drain.

7. The method as claimed in claim 1, in which the drains are arranged at the apices of equilateral triangles.

8. The method as claimed in claim 1, in which the drains are connected together so as to form a permanent lattice assembly.

9. A method of producing a refractory lining on a bottom of a metallurgical vessel, comprising the steps of: providing a plurality of drains constituted by elongate hollow bodies, each of the drains having a base designed to maintain it in a substantially perpendicular position; arranging at least one removable circular mould on the bottom of the vessel; arranging the plurality of drains on the bottom of the vessel with the longitudinal axis of the drains being substantially perpendicular to the bottom of the vessel and with the drains resting against the at least one mould; filling the bottom of the vessel with crude wet sand; compacting the crude sand around the drains to form a refractory lining; removing the at least one mould; and drying the sand with evaporation of water in the sand through the drains.

10. The method as claimed in claim 9, in which the drains are arranged on a series of concentric circles whose centre coincides with that of the bottom.

* * * * *